United States Patent [19]

Artzberger

[11] Patent Number: 4,859,114

[45] Date of Patent: Aug. 22, 1989

[54] DIRECTIONAL CONTROL SYSTEM FOR A RIDING-TYPE SURFACE WORKING MACHINE

[75] Inventor: Thomas G. Artzberger, Menomonee Falls, Wis.

[73] Assignee: M-B-W Inc., Slinger, Wis.

[21] Appl. No.: 173,171

[22] Filed: Mar. 24, 1988

[51] Int. Cl.[4] ..... E01C 19/22

[52] U.S. Cl. ..... 404/112

[58] Field of Search ..... 404/83, 112; 51/174, 51/177; 180/6.2, 6.24, 6.54, 7.1; 280/492

[56] References Cited

U.S. PATENT DOCUMENTS

| | | | |
|---|---|---|---|
| 2,389,798 | 11/1945 | Main . | |
| 2,624,250 | 1/1953 | Bird . | |
| 2,869,442 | 1/1959 | Mincher | 404/112 |
| 2,887,934 | 5/1959 | Whiteman | 404/112 |
| 2,898,826 | 8/1959 | Livermont | 404/112 |
| 3,080,002 | 3/1963 | DuPont . | |
| 3,412,657 | 11/1968 | Colizza et al. . | |
| 3,936,212 | 2/1976 | Holz, Sr. et al. | 404/112 |
| 4,046,484 | 9/1977 | Holz, Sr. et al. | 404/112 |
| 4,312,603 | 1/1982 | Whiteman, Jr. | 404/112 |
| 4,358,123 | 11/1982 | Richards | 280/17.13 |
| 4,367,880 | 1/1983 | Harding | 280/47.13 |
| 4,676,691 | 6/1987 | Morrison | 404/112 |
| 4,710,055 | 12/1987 | Maass et al. | 404/112 |

*Primary Examiner*—Stephen J. Novosad
*Assistant Examiner*—John F. Letchford
*Attorney, Agent, or Firm*—Andrus, Sceales, Starke & Sawall

[57] ABSTRACT

An improved directional control mechanism for a riding-type surface working machine. The machine includes a pair of frame sections which are disposed in fore and aft relation. A rotor that carries surface working implements, such as trowel blades, is mounted for rotation on each frame section and an engine is mounted on one of the frame sections and is operably connected to the rotors to drive the rotors in opposite directions. The frame sections are connected together by a mounting arrangement that permits each frame section to be tilted in a fore and aft direction, as well as laterally, with respect to the other frame section. Manually operated levers are connected to each frame section to pivot the frame sections in a fore and aft direction, while a foot pedal is operable to tilt the frame sections laterally. By selective tilting of the frame sections, directional control of the machine can be obtained.

18 Claims, 2 Drawing Sheets

DIRECTIONAL CONTROL SYSTEM FOR A RIDING-TYPE SURFACE WORKING MACHINE

BACKGROUND OF THE INVENTION

Multi-trowel riding-type machines are frequently used to finish a working surface, such as concrete. The conventional multi-trowel machine includes a frame and a pair of rotors are mounted for rotation on the frame and each rotor includes a plurality of surface working members or trowels which engage the surface to be finished. An engine is mounted on the frame and is operably connected to the rotors to drive the rotors in opposite directions.

To obtain directional control or steering of the machine, downward pressure is exerted at selected locations on the path of travel of each of the rotors. U.S. Pat. No. 3,936,212 shows a manner of directional control of a multi-trowel riding-type machine, where downward pressure is applied at selected locations through action of a hand lever and foot pedal to the rotor guards to thereby tilt the rotors relative to the frame and achieve directional control.

U.S. Pat. No. 4,710,055 shows a different type of mechanism for achieving directional control, in which the upper end of each rotor is journalled within an eccentric bearing. Through manual controls the eccentrics are rotated to thereby tilt the rotors relative to the frame and achieve steering or directional control of the machine.

SUMMARY OF THE INVENTION

The invention is directed to an improved directional control mechanism for a surface working machine. In contrast to prior art systems, in which the rotors are tilted relative to the frame, the present invention takes a different approach and mounts each rotor in non-tilting relation with respect to a frame section. By tilting the frame sections relative to each other, directional control can be achieved.

More specifically, the multi-trowel machine of the invention includes a pair of frame sections which are disposed in fore and aft relation. A rotor that carries a plurality of surface working members, such as trowels, is mounted for rotation on each frame section. An engine is supported on one of the frame sections and is operably connected to the rotors to drive the rotors in opposite directions.

The frame sections are connected together by a mounting arrangement that permits each frame section to be tilted in a fore and aft direction with respect to the other frame section. In addition, each frame section can be tilted laterally along a central longitudinal axis with respect to the other frame section. Manually operated levers are connected to each frame section to tilt the frame sections in the fore and aft direction, while a foot pedal is operably connected to the frame sections to tilt the sections laterally about the longitudinal axis.

By selective tilting of the frame sections relative to each other as the rotors are operated, the direction of travel of the machine can be precisely controlled.

The invention provides a simple and relatively inexpensive mechanism for providing directional control of a riding-type multi-trowel surface working machine.

The invention also provides a simplified drive from the engine to the rotors, as compared with machines as used in the past.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
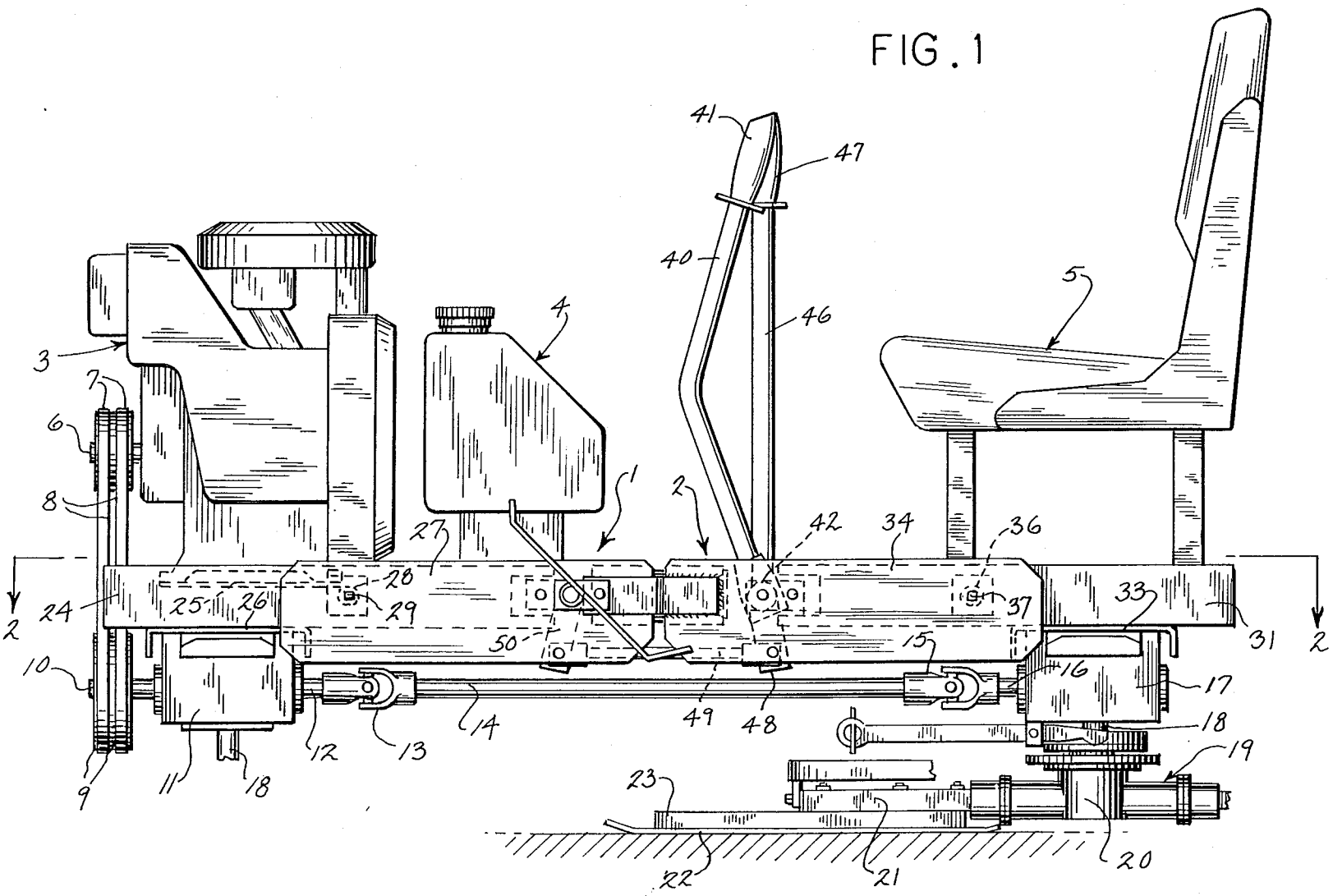
FIG. 1 is a fragmentary side elevation of the surface working machine of the invention.

The drawings illustrate a riding-type multitrowel surface working machine. The machine includes a pair of frame sections 1 and 2 which are disposed in fore and aft relation. A conventional internal combustion engine 3 is mounted on frame section 1, along with a fuel tank 4, while an operator's seat 5 is supported on frame section 2.

Figure 2:
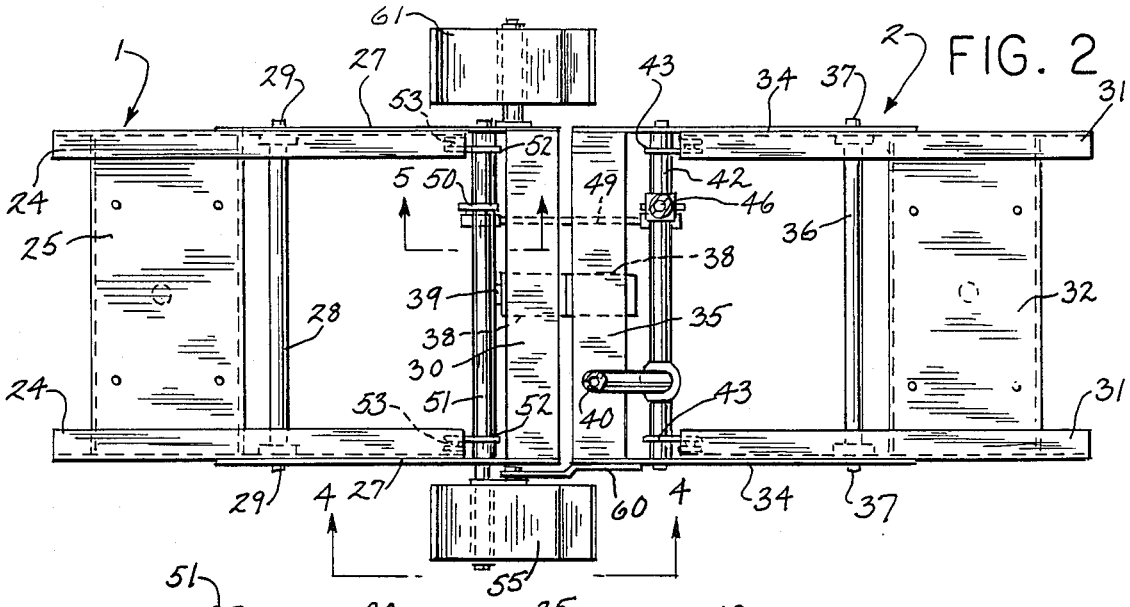
FIG. 2 is a horizontal section taken along line 2—2 of FIG. 1.

As shown in FIG. 1, the drive shaft 6 of engine 3 carries pulleys 7 that are connected by belts 8 to pulleys 9 on input shaft 10 of gear box 11, which is mounted on frame section 1. The horizontal output shaft 12 of gear box 11 is connected by a universal joint 13 to a longitudinally extending shaft 14, which extends beneath frame sections 1 and 2. The opposite end of shaft 14 is connected by a universal joint 15 to the input shaft 16 of gear box 17, which is mounted on frame section 2. Each gear box 11 and 17 is provided with a vertical output shaft 18, which is connected to a rotor 19. With this drive arrangement, operation of the engine will act through gear boxes 11 and 17 to rotate rotors 19 in opposite directions, as shown by the arrows in FIG. 2.

Rotors 19 each include a hub 20 and a plurality of arms 21 extend radially outward from each hub and carry a group of trowels or surface working members 22. The longitudinal edge of each trowel 22 leading in the direction of rotation is inclined upwardly as indicated by 23.

A conventional pitch control mechanism, not shown, is connected to each of the trowels 22, to rotate the trowels simultaneously about their respective axes to vary the pitch or inclination of the trowels with respect to the working surface. The construction of the rotors 19 and the pitch control mechanism is conventional and in itself forms no part of the present invention.

Frame 1 is composed of a pair of parallel channel-shaped side rails 24, which are connected by a horizontal plate 25 that supports engine 3. In addition, a channel-shaped plate 26 connects the lower edges of side rails 24 and is positioned beneath plate 25. Gear box 11 is mounted to the underside of channel plate 26, as shown in FIG. 1.

Frame 1 also includes a pair of side plates 27, and the side rails 24 are mounted for fore and aft tilting movement relative to the side plates 27, by a shaft 28. Studs 29 extend through openings in side plates 27 and are connected to the ends of the shaft. The rear ends of side plates 27 are connected together by a box-shaped beam 30. With this construction, the side rails 24, which carry the engine 3 and the rotor 19, can be pivoted about the axis of shaft 28 in a fore and aft direction.

Frame 2 is constructed similarly to frame 1 and includes a pair of spaced, parallel, channel-shaped side rails 31 which are connected together by a plate 32 that supports the operator's seat 5. In addition, a channel-shaped plate 33 is connected to the under surfaces of rails 31 and supports the gear box 17.

As in the case of frame 1, frame 2 also includes a pair of side plates 34, the forward ends of which are connected by a box-shaped beam 35.

The side rails 31, which carry the operator's seat 5 and gear box 17, can be pivoted relative to the side plates 34 about the axis a transverse shaft 36, which extends between the side rails. Studs 37 extend through openings in the side rails and are threaded into the ends of the shaft 36. With this construction, the side rails 31, which carry the gear box 17 and rotor 19, can be pivoted relative to the side plates 34 and beam 35.

In addition to fore and aft tilt, frame sections 1 and 2 can be tilted laterally relative to each other. In this regard, beams 30 and 35 are provided with aligned longitudinal openings which receive tubes 38 and a pin 39 is journalled within each of the tubes 38. Thus, each frame section can be pivoted relative to the other frame section about the axis of pin 39.

To tilt the rear frame section 2, in a fore and aft direction, a lever 40 having an upper handle section 41 is mounted forwardly of the seat 5 and the lower end of lever 40 is secured to a shaft 42 that extends tranversely between side plates 34. A pair of arms 43 are connected to the respective ends of shaft 42 and the rear ends of arms 43 carry rollers 44, which are mounted within recesses or slots 45 formed in plates 45*a* that are secured to the respective side rails 31. With this construction forward movement of the level 40 will pivot the rollers 44 upwardly within recesses 45 to tilt the forward end of rear frame section 2 upwardly about the axis of shaft 36. Conversely, rear movement of lever 40 will tilt arms 43 downwardly causing rollers 44 to move downwardly in recesses 45 to tilt the forward end of frame section 2 downwardly about the axis of shaft 36.

The tilting mechanism for forward frame section 1 includes a lever 46 having a handle portion 47 on its upper end, and the lower end of lever 46 is journalled for rotation on shaft 42. The lower end 48 of lever 46 is pivotally connected to one end of a link 49, which extends forwardly beneath frame sections 1 and 2. The forward end of link 49 is pivotally connected to a vertical arm 50, which is secured to shaft 51. Shaft 51 extends tranversely of frame section 1 and is journalled within a sleeve 51*a* secured to the side plates 27.

Mounted on opposite ends of shaft 51 are arms 52, and the forward ends of arms 52 carry rollers 53, which are mounted within recesses 54 formed in plates 54*a* secured to the rear ends of side rails 24. With this arrangement, forward movement of lever 46 will move link 49 rearwardly, pivoting arms 52 and moving rollers 53 downwardly within recesses 54 to pivot the rear end of forward frame section 1 downwardly about the axis of shaft 28. Rear movement of lever 46 will operate in the opposite manner to give the rear end of frame section 1 upwardly about the axis of shaft 28. Thus, through operation of the levers 40 and 46, the frame sections 1 and 2 can be individually tilted in a fore and aft direction relative to each other. As the gear boxes 11 and 17 are attached to frame sections 1 and 2, the universal joints 13 and 15 act to compensate for this pivotal movement between the frame sections to maintain the drive system in engagement.

Figure 3:
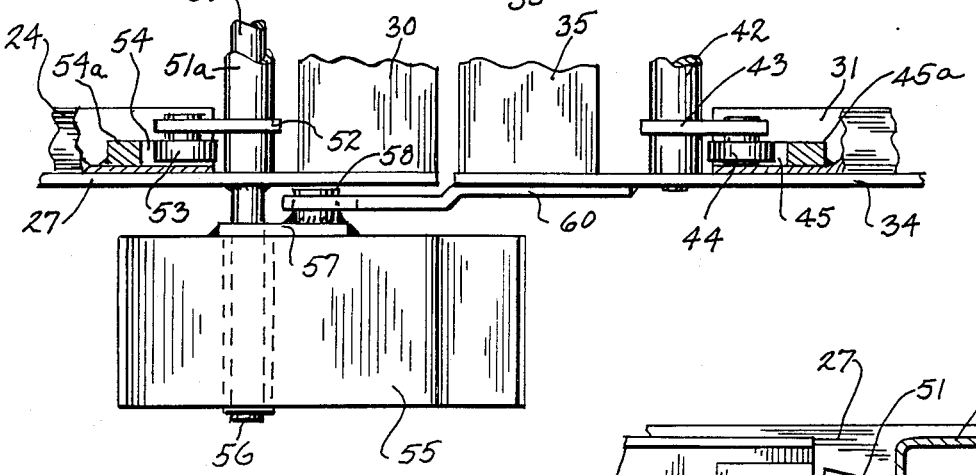
FIG. 3 is a fragmentary enlarged plan view.
Figure 5:
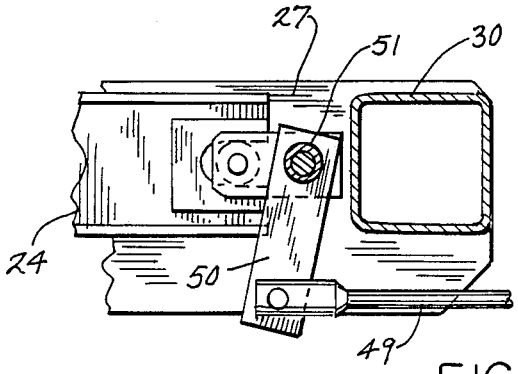
FIG. 5 is a section taken along line 5—5 of FIG. 2.
Figure 4:
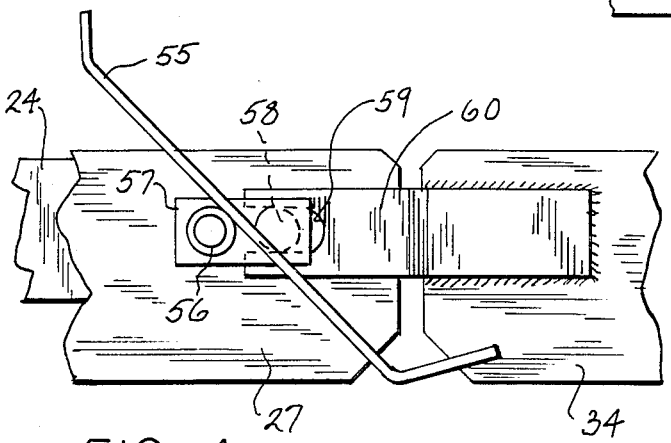
FIG. 4 is an enlarged fragmentary side elevation taken along line 4—4 of FIG. 2.

The mechanism for tilting the frame sections relative to each other in a lateral direction is best shown in FIGS. 3 and 5. A foot pedal 55 is journalled on shaft 56, which projects outwardly from one of the side plates 27. Arm 57 is secured to the side edge of pedal 55, and the arm carries a pin 58, which is disposed within a slot 59 in a strap 60 that is secured to side plate 34.

As the upper end of foot pedal 55 is depressed, arm 57 will pivot upwardly around the axis of shaft 56, moving pin 58 upwardly within slot 59 to thereby pivot the rear frame section 2 about the axis of pin 39. Conversely, depressing the rear lower end of foot pedal 55 will pivot arm 59 downwardly, moving pin 58 downwardly in slot 59 to pivot the frame section 2 downwardly around the axis of longitudinal pin 39.

Therefore, with movement provided by the levers 40 and 46, as well as foot pedal 55, frame sections 1 and 2 can be pivoted both in a fore and aft direction and a side-to-side relation relative to each other. With a combination of pivotal movements, the machine can be steered in all directions over the working surface or terrain.

A clutch pedal 61 is mounted on the opposite side of frame section 1 from pedal 55, and acts to operate the clutch for the engine 3 in a conventional manner.

A protective guard or frame, not shown, is normally positioned around the machine to prevent accidental contact with the rotating trowels 22.

The rotors 19 rotate in opposite directions and, as an example, forward movement for the machine, can be obtained by depressing the upper forward end of pedal 55 to provide lateral tilting of the frame sections. With downward pressure at opposite sides of frame sections 1 and 2, the machine will move forwardly.

To move the machine to the rear, pressure is applied to the rear lower end of pedal 55, thereby tilting the frame sections 1 and 2 relative to each other in a lateral manner. With the application of downward pressure in these areas, the machine will move to the rear.

By moving both levers 40 and 46 to the rear, the frame sections 1 and 2 will tilt relative to each other in a fore and aft direction to apply a downward force at the opposite ends of the frame sections. This downward force will move the machine to the right with a crabbing type of motion.

Conversely, moving both levers 40 and 46 forward, down pressure is applied at the adjacent ends of the frame sections i.e. rear end of the front frame 1 and the front end of the rear frame 2. The downward force applied to the rotors in these areas will crab the machine to the left.

To turn the machine to the right, lever 46 is moved forward, while lever 40 is moved to the rear, so that a downward force is applied to the front end of each frame section 1 and 2.

Conversely, to turn to the left, downward pressure is applied to the back of each frame section 1 and 2, by moving the lever 46 to the rear and moving the lever 40 forward.

Thus, by a combination of movements of the levers 40 and 46, as well as the foot pedal 55, movement of the machine can be precisely controlled over the working surface or terrain.

Various modes of carrying out the invention are contemplated as being within the scope of the following claims particularly pointing out and distinctly claiming the subject matter which is regarded as the invention.

I claim:

1. A riding-type surface working machine, comprising a pair of frame means disposed in fore and aft relation, a rotor carried by each frame means with each rotor including a plurality of rotatable surface working members, each rotor being mounted in non-tiltable relation to the respective frame means, drive means operably connected to each rotor for rotating the rotors in opposite directions, first mounting means for mounting each frame means for relative tilting movement in a fore and aft direction with respect to the other frame means, second mounting means for mounting each frame means for relative tilting movement in a lateral direction with respect to the other frame means, first operating means for effecting relative tilting movement of said frame means in said fore and aft direction, and second operating means for effecting relative tilting movement of said frame means in said lateral direction, selectively relative tilting of said frame means in said fore and aft and lateral direction causing directional movement of said machine on a working surface.

2. The machine of claim 1, wherein said drive means comprises an engine mounted on a first of said frame means and operably connected to a first rotor associated with said first frame means, and connecting means connecting said first rotor to a second rotor associated with the second of said frame means.

3. The machine of claim 2, wherein said connecting means comprises universal joint means to accommodate relative tilting of said frame means.

4. The machine of claim 1, wherein said first mounting means includes a separate pivot axis for each frame means, said pivot axes being spaced apart and extending transversely of said machine.

5. The machine of claim 4, wherein said operating means includes a manually operable lever means connected to each frame means at a location spaced from the respective pivot axis, each lever means being constructed and arranged so that forward and aft movement of said lever means will tilt the corresponding frame means about the respective axis.

6. A riding-type surface working machine comprising first frame means, second frame means disposed in a fore-and-aft relation with said first frame means, said first and second frame means being mounted for relative tilting movement in both a fore-and-aft and lateral direction relative to each other, first operating means for effecting relative tilting movement in said fore-and-aft direction between said first and second frame means, second operating means for effecting relative lateral tilting between said first and second frame means, a rotor carried by each frame means with each rotor including a plurality of rotatable surface working members, each rotor being mounted in non-tilting relation to the respective frame means, drive means operably connected to each rotor for rotating the rotors in opposite directions, said drive means being mounted on said first frame means and operably connected to the rotor of said first means, and drive connecting means operably connecting said drive means with the rotor of said second frame means, said drive connecting means being constructed and arranged to accommodate relative tilting between said first and second frame means.

7. A riding-type surface working machine, comprising a pair of frame means disposed in fore and aft relation, a rotor carried by each frame means with each rotor including a plurality of rotatable surface working members, drive means operably connected to each rotor for rotating the rotors in opposite directions, first mounting means for mounting said frame means for relative tilting movement in a fore and aft direction, second mounting means for mounting said frame means for relative tilting movement in a lateral direction, said second mounting means comprising a longitudinal pivot shaft interconnecting adjacent ends of said frame means, first operating means for effecting relative tilting movement of said frame means in said fore and aft direction, and second operating means for effecting relative tilting movement of said frame means in said lateral direction, selectively relative tilting of said frame means in said fore and aft and lateral direction causing directional movement of said machine on a working surface.

8. The machine of claim 7, wherein said second operating means comprises means for exerting a force on a side portion of a first of said frame means at a location spaced from said longitudinal pivot shaft to thereby tilt a first of said frame means relative to a second of said frame means about the axis of said shaft.

9. The machine of claim 8, wherein said means for exerting a force comprises a foot pedal mounted for pivotal movement on one of said frame means, and connecting means interconnecting said foot pedal to the other of said frame means, said connecting means being constructed and arranged so that pivotal movement of said pedal will tilt said frame means relative to each other in a lateral direction.

10. A surface working machine, comprising, a first frame, a second frame disposed in a fore-and-aft direction with respect to said first frame, a first frame section mounted for tilting movement relative to said first frame in said fore-and-aft direction, a second frame section mounted for tilting movement relative to said second frame in said fore-and-aft direction, means for mounting said frames for lateral tilting movement relative to each other about a fore-and-aft axis, a rotor carried by each frame section and including a plurality of rotatable surface working members, drive means operably connected to the rotors for rotating the rotors in opposite directions, first tilting means for individually tilting each frame section relative to the respective frame in said fore and aft direction, and second tilting means means for tilting said frames relative to each other about said axis, selectively relative tilting of said frame sections and said frames causing directional control of the machine on a working surface.

11. The machine of claim 10, wherein said drive means is mounted on one of said frame sections, and is operably connected to the rotor associated with said one frame section, said machine also including a drive connection connecting said rotors, said drive connection being constructed and arranged to accommodate tilting movement of said frame sections relative to each other.

12. The machine of claim 11, wherein said drive connection comprises universal joint means.

13. The machine of claim 10, wherein each frame includes a lateral pivot axis, each frame section being mounted for pivotal movement on the respective pivot axis.

14. The machine of claim 13, wherein said first tilting means comprises a pair of manually operable levers, and linkage means interconnecting each lever with the respective frame section, each linkage means being constructed and arranged so that movement of the respective lever will tilt the respective frame section about the corresponding lateral pivot axis.

15. The machine of claim 10, and including a fore-and-aft pivot axis connecting said frames to permit relative lateral tilting movement of said frames.

16. The machine of claim 15, wherein said second tilting means comprises means for exerting a force on a side portion of one of said frames at a location spaced from said fore-and-aft axis.

17. The machine of claim 16, wherein said means for exerting a force comprises a foot pedal, and a linkage interconnecting said foot pedal and said side portion.

18. A riding-type surface working machine comprising first frame means, second frame means disposed in a fore-and-aft relation with said first frame means, said first and second frame means being mounted for relative tilting movement in both fore-and-aft and lateral directions relative to each other, first operating means for effecting relative tilting movement in said fore-and-aft direction between said first and second frame means, second operating means for effecting relative lateral tilting between said first and second frame means, a rotor carried by each frame means with each rotor including a plurality of rotatable surface working members, drive means operably connected to each rotor for rotating the rotors in opposite directions, said drive means being mounted on said first frame means and operably connected to the rotor of said first frame means, an operator's seat mounted on said second frame means, and drive connecting means operably connecting said drive means with the rotor of said second frame means, said drive connecting means being constructed and arranged to accommodate relative tilting between said first and second frame means.

* * * * *

UNITED STATES PATENT AND TRADEMARK OFFICE

CERTIFICATE OF CORRECTION

PATENT NO. : 4,859,114

DATED : August 22, 1989

INVENTOR(S) : THOMAS G. ARTZBERGER

It is certified that error appears in the above-identified patent and that said Letters Patent is hereby corrected as shown below:

Col. 5, Line 58, CLAIM 6, After "first" insert ---frame---;

Signed and Sealed this

Ninth Day of April, 1991

*Attest:*

HARRY F. MANBECK, JR.

*Attesting Officer*

*Commissioner of Patents and Trademarks*